United States Patent [19]

Kaito et al.

[11] 4,154,602

[45] May 15, 1979

[54] METHOD OF DENITRIDING A HIGH CHROMIUM MOLTEN STEEL WITH A MINIMUM CHROMIUM LOSS

[75] Inventors: Hiroyuki Kaito, Takarazuka; Takashi Ohtani; Shoji Iwaoka, both of Ashiya; Yukio Oguchi, Chiba; Shuya Yano, Chiba; Akio Ejima, Chiba, all of Japan

[73] Assignee: Kawasaki Steel Corporation, Kobe, Japan

[21] Appl. No.: 872,993

[22] Filed: Jan. 27, 1978

[30] Foreign Application Priority Data

Jan. 31, 1977 [JP] Japan ..... 52-8716

[51] Int. Cl.[2] ..... C21C 7/10; C22C 33/00

[52] U.S. Cl. ..... 75/49; 75/59; 75/60; 75/130.5

[58] Field of Search ..... 75/49, 59, 60

[56] References Cited

U.S. PATENT DOCUMENTS

| | | | |
|---|---|---|---|
| 3,205,067 | 9/1965 | King | 75/59 |
| 3,773,496 | 11/1973 | Knuppel | 75/49 |
| 3,788,836 | 1/1974 | Muscatell | 75/49 |
| 3,976,473 | 8/1976 | Katayama | 75/59 |

*Primary Examiner*—P. D. Rosenberg

[57] ABSTRACT

A method of denitriding a high chromium molten steel with a minimum chromium loss is disclosed. A high chromium molten steel containing 0.8–2.5% of C and 10–35% of Cr is denitrided to a final nitrogen content of not more than 40 ppm in a ladle under vacuum by flowing an inert gas into molten steel at a flow rate of not less than 15 Nl/min per ton of molten steel and at the same time blowing oxygen gas against molten steel until carbon content [C] in molten steel satisfies the following equations (1) and (2) in accordance with the carbon content prior to decarburization [C] of molten steel:

$$[C] \leqq [\underline{C}]\ 0.3, \text{ when } 0.8 \leqq [\underline{C}] \leqq 1.0\% \quad (1)$$

$$[C] \leqq 55/70[\underline{C}] - 6/70, \text{ when } 1.0 \leqq [\underline{C}] \leqq 2.5\% \quad (2)$$

4 Claims, 4 Drawing Figures

METHOD OF DENITRIDING A HIGH CHROMIUM MOLTEN STEEL WITH A MINIMUM CHROMIUM LOSS

BACKGROUND OF THE INVENTION

1. Field of the Invention

The present invention relates to a method of denitriding a high chromium molten steel with a minimum chromium loss, and more particularly to a method of denitriding a high chromium molten steel in a ladle under vacuum so as to reduce a nitrogen content in molten steel to not more than 0.0040% (40 ppm) while restraining a chronium loss to not more than 0.3%.

2. Description of the Prior Art

It is known that the presence of nitrogen in steel seriously exerts on a quality of products, and particularly in case of stainless steel containing a large amount of chromium, the reduction of nitrogen content considerably improves intergranular corrosion resistance and toughness. Recently, large-sized and thick-walled steel materials have a tendency to be used in a welded state after assembled into a constructional body by welding because it is very difficult to anneal the constructional body after the welding. Therefore, it is demanded to use the material having an extremely low nitrogen content in view of the toughness. However, the supply of low-nitrogen and tough steel materials has not yet been accomplished satisfactorily. Especially, in case of stainless steel material having a high chromium content of 25 to 35%, it is known that the nitrogen content is preferably not more than 0.0040%. However, the production of such extremely low nitrogen material is only carried out by an electron beam process under a high vacuum or a vacuum melting process using a high purity material, which have a drawback that production cost becomes very expensive.

As the method of denitriding molten steel, there is widely used a vacuum denitriding method wherein an equilibrium nitrogen content in molten steel is reduced by lowering a partial pressure of nitrogen gas in the treating atmosphere. Between the nitrogen partial pressure in the atmosphere and the nitrogen content in molten steel, there is realized an equilibrium relation as shown in the following equation according to Sievert's law:

$$\underline{N}=K\sqrt{P_{N2}}$$

wherein $\underline{N}$ represents an equilibrium nitrogen content in molten steel, $P_{N2}$ represents a nitrogen partial pressure and K represents a constant (depending upon temperature).

Usually, a pressure in the treating atmosphere or a vacuum degree realized by a ladle degassing process or the like is the order of $10^{-1}$ Torr and in this case, it is experienced that the nitrogen content in the resulting steel is higher than the equilibrium value. This is due to the fact that the actual operation is closed before the nitrogen content in molten steel does not yet reach to the equilibrium value because it is obliged to considerably shorten the vacuum treating time in the actual operation.

Therefore, it is necessary to obviate such a restriction in the actual operation that it is difficult to conduct the denitriding up to the equilibrium value in a static state. For this purpose, there have hitherto been made efforts on a process for approaching the nitrogen content to the equilibrium value as far as possible based on kinetics of denitriding reaction. For example, there is a vacuum degassing process or the like wherein an inert gas such as argon and the like is flowed into molten steel from the bottom of the ladle lined with porous refractory bricks so as to stir molten steel. In this case, it is attempted to proceed the denitriding in a short time by accelerating the following reaction formula: $2\underline{N}\rightarrow N_2$ (g) while using fine bubbles of the inert gas as nuclei. According to this process, however, the amount of the inert gas flowed is critical. As is well-known, the maximum limit of the flow amount is 40 Nl/min per ton of molten steel in a ladle with a usual size, for example, about 50 tons. If the flow amount exceeds the maximum limit, erosion of the porous refractory bricks is considerably promoted and also the production cost rises, so that the use of such excessive flow amount is not favorable. Therefore, the flowing has hitherto been practised by using the inert gas in an amount of not more than 40 Nl/min per ton of molten steel.

On the other hand, it is also known that when the total pressure in vacuum degassing of molten steel is maintained at 0.1 to 1 Torr in terms of a partial pressure carbon monoxide gas (Pco), even if the flow amount of inert gas is increased, there is not found a significant difference in the denitrided amount or denitriding rate, because the absolute amount of inert gas to be flowed under the above condition is still insufficient to effect the denitriding of molten steel in which $N_2$ (g) produced by the reaction $2N\rightarrow N_2$ (g) is caught by surfaces of inert gas bubbles flowed into molten steel and then removed from the surface of molten steel into the treating atmosphere. Therefore, it is necessary to use an enormous flow amount of inert gas in order to promote the denitriding reaction and considerably reduce the nitrogen content in molten steel by the vacuum degassing process with the inert gas. This is guessed to be uneconomical and has not been practised.

Recently, the production of high alloy steels such as stainless steel and the like has been performed by a vacuum decarburization process wherein decarburization refining is carried out by blowing gaseous oxygen against molten steel in a ladle under vacuum. According to this process, the decarburization is continued till a predetermined carbon content, while preventing oxidation loss of chromium to the utmost, by utilizing the feature that carbon has a strong affinity with oxygen as compared with chromium under vacuum. During the oxygen blowing, a large amount of fine carbon monoxide bubbles are produced in molten steel by the reaction $\underline{C}+\underline{O}\rightarrow CO$ (g), which contribute to considerably promote the denitriding reaction. For example, when only the oxygen gas is blown against molten steel under vacuum, the amount of CO gas evolved is usually 160 to 170 Nl/min per ton of molten steel.

Accordingly, it is apparent from the above that the amount of gas blown for promoting the denitriding of molten steel can remarkably be increased by using oxygen gas and argon gas together in the vacuum degassing process as compared with the case of flowing only argon gas into molten steel from the bottom of the ladle.

In any case, it is considered that the higher the carbon content prior to the treatment of molten steel, the more the amount of CO gas evolved and as a result, the denitriding reaction is advantageously promoted. However, when the carbon content prior to the treatment exceeds a certain predetermined value, there are caused such drawbacks that molten steel in the ladle scatters due to boiling accompanied with violent formation of CO bubbles, the decarburization time becomes long, the oxidation loss of chromium increases and the yield of steel lowers. Therefore, the carbon content prior to the treatment of molten steel has been required to be limited to not more than 0.6% until now. Considerably, the finally realized nitrogen content is 0.0070% at most, which is still unsatisfactory in view of the quality improvement.

SUMMARY OF THE INVENTION

It is an object of the present invention to eliminate the drawbacks of the prior art usually known as the denitriding process and to provide a method of producing a high chromium steel having an extremely low-nitrogen content.

According to the present invention, there is provided a method of denitriding a high chromium molten steel to a nitrogen content of not more than 0.0040% with a minimum chromium loss, which comprises flowing an inert gas into a high chromium molten steel containing 0.8 to 2.5% of carbon and 10 to 35% of chromium at a flow rate of not less than 15 Nl/min per ton of molten steel from a bottom of a ladle under vacuum and at the same time, blowing an oxygen gas against molten steel until a carbon content [C] in molten steel satisfies the following equations (1) and (2) in accordance with the carbon content prior to decarburization [$\underline{C}$] of molten steel:

$$[C] \leqq [\underline{C}] - 0.3, \text{ when } 0.8 \leqq [\underline{C}] \leqq 1.0\% \quad \ldots (1)$$

$$[C] \leqq 55/70[\underline{C}] - 6/70, \text{ when } 1.0 \leqq [\underline{C}] \leqq 2.5\% \quad \ldots (2)$$

BRIEF DESCRIPTION OF THE DRAWINGS p

The invention will now be described with reference to the accompanying drawings, wherein.

DESCRIPTION OF THE PREFERRED EMBODIMENT

Figure 1:
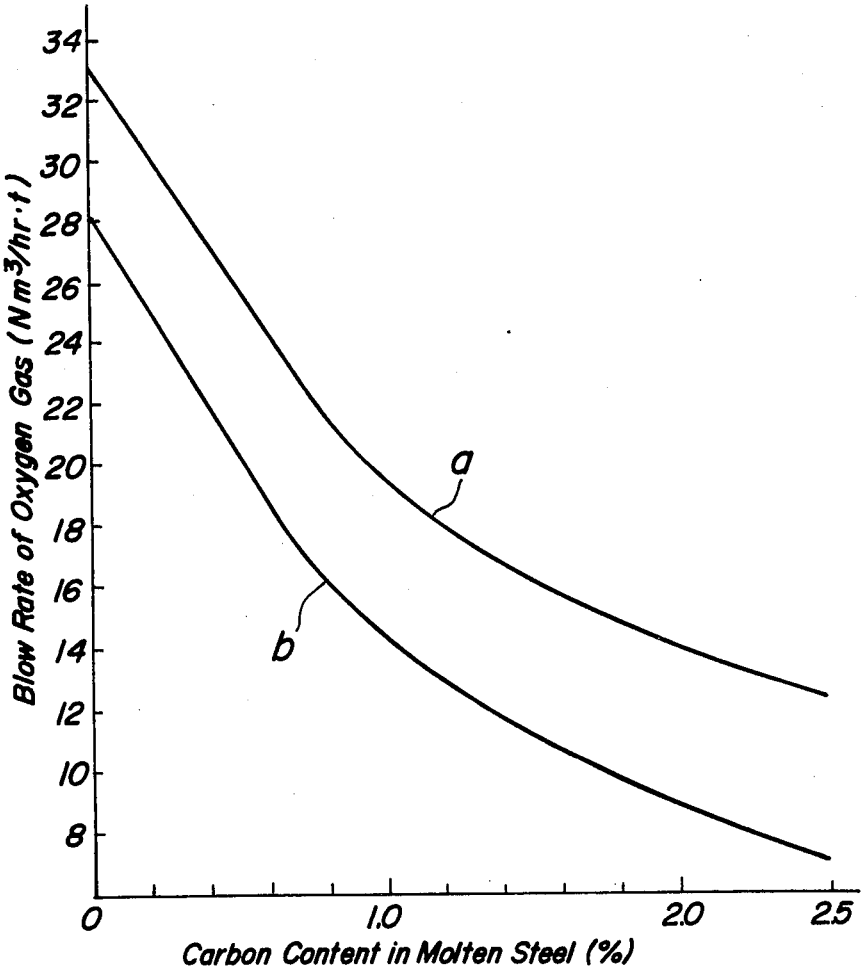
FIG. 1 is a graph showing a relation between the carbon content in molten steel and the blow rate of oxygen gas.

According to the present invention, a high chromium molten steel tapped from a steel-making furnace such as converter, electric furnace, open hearth furnace or the like is poured into a ladle and the ladle is evacuated to a pressure of 6–60 Torr. Under such vacuum, an inert gas is flowed into molten steel from the bottom of the ladle, while oxygen gas is blown against the surface of molten steel. During the blowing, the relation between the carbon content in molten steel and the reasonable oxygen blow rate per ton of molten steel is examined to obtain a result shown in FIG. 1. It has been found from FIG. 1 that it is preferable to blow oxygen gas against molten steel at an oxygen blow rate ranging between curves a and b of FIG. 1. When the oxygen blow rate exceeds the curve a, molten steel overflows from the ladle due to the occurrence of excessive splashes, while when the oxygen blow rate is below the curve b, decarburization rate becomes considerably slow and requires a long time. Further, in the oxygen blowing, a distance between the delivery port for oxygen and the surface of molten steel is preferable to be selected within a range of 500 to 1,500 mm. When the distance is smaller than 500 mm, there is a risk of overflowing molten steel from the ladle due to hard blowing, while when the distance exceeds 1,500 mm, decarburization refining time requires a long time.

Figure 2:
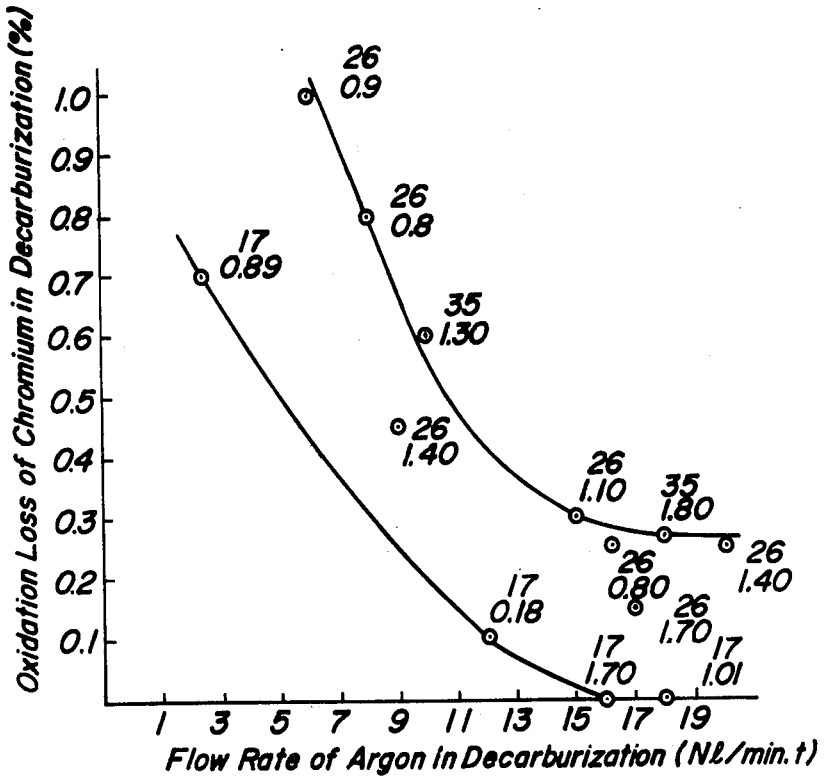
FIG. 2 is a graph showing a relation between the flow rate of argon gas in decarburization and the oxidation loss of chromium in decarburization.

Under such circumstances as described above, the relation between the flow rate of argon gas in decarburization and the oxidation loss of chromium in decarburization is examined to obtain a result shown in FIG. 2. In FIG. 2, an upper reference numeral near symbol ⦿ represents a chromium content (%) prior to the decarburization of molten steel according to the present invention and a lower reference numeral near symbol ⦿ represents a carbon content (%) prior to the decarburization of molten steel. It can be seen from FIG. 2 that the oxidation loss of chromium can be restrained to not more than 0.3% when flowing argon gas in an amount of not less than 15 Nl/min per ton of molten steel irrespective of the carbon content prior to the decarburization. The upper limit of inert gas flow rate is critical in viewpoints of the size of the ladle usually used and the prevention of excessive dissolved loss due to the flow of molten steel and slag, and is preferably 40 Nl/min per ton of molten steel.

Figure 3:
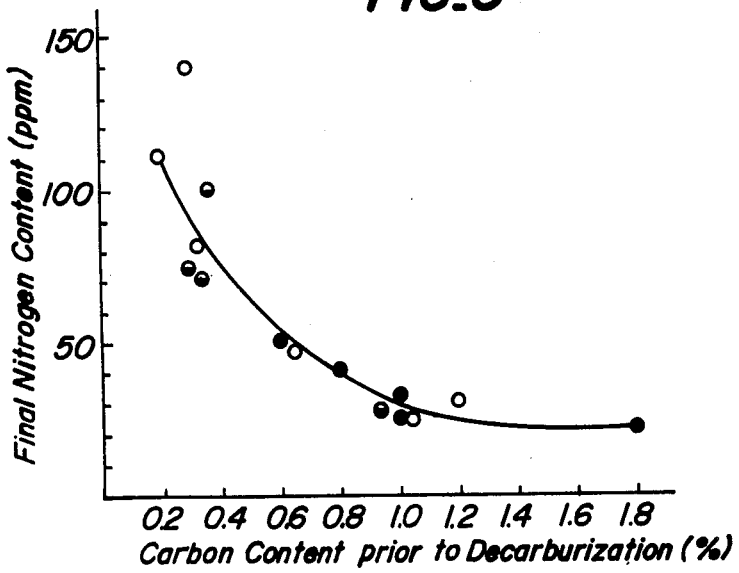
FIG. 3 is a graph showing a relation between the carbon content prior to decarburization of molten steel and the final nitrogen content.

In FIG. 3 is shown a relation between the carbon content prior to the decarburization and the final nitrogen content of molten steel according to the present invention. In FIG. 3, symbol ○ represents molten steel prior to the decarburization having an initial nitrogen content of more than 250 ppm, symbol ◒ represents molten steel prior to the decarburization have an initial nitrogen content of 200 to 250 ppm, and symbol ● represents molten steel prior to the decarburization having an initial nitrogen content of less than 200 ppm. It can be seen from FIG. 3 that extremely low nitrogen and high chromium steel having a final nitrogen content of not more than 40 ppm can be produced from high chromium molten steel having a carbon content of not less than 0.8% according to the method of the present invention irrespective of the initial nitrogen content.

According to the present invention, the reason why the carbon and chromium contents prior to the decarburization are limited to predetermined ranges is as follows:

When the carbon content [$\underline{C}$] prior to the decarburization is smaller than 0.8%, the final nitrogen content of not more than 40 ppm can not be attained, while when the carbon content [$\underline{C}$] is larger than 2.5%, there is a risk of overflowing molten steel from the ladle due to bubbling generated by violent reaction of carbon with oxygen when oxygen is blown against molten steel while flowing argon gas into molten steel from the bottom of the ladle. Therefore, the carbon content [$\underline{C}$] prior to the decarburization of molten steel should be within a range of 0.8 to 2.5%.

When the chromium content is smaller than 10%, high chromium steel aiming at the present invention can not be obtained, while when the chromium content is larger than 35%, decarburization reaction rate in the oxygen blowing is low and as a result, denitriding is hardly promoted by means of argon gas and carbon monoxide gas and the final nitrogen content of not more than 0.0040% can not be attained. Therefore, the chromium content prior to the decarburization of molten steel should be within a range of 10 to 35%.

According to the present invention, the reason why the flow amount of inert gas is not less than 15 Nl/min per ton of molten steel is based on the fact that when the flow amount is less than 15 Nl/min, the oxidation loss of chromium becomes larger than 0.3% as seen from FIG. 2 and yield considerably lowers and as a result, the object of the present invention can not be achieved.

Figure 4:
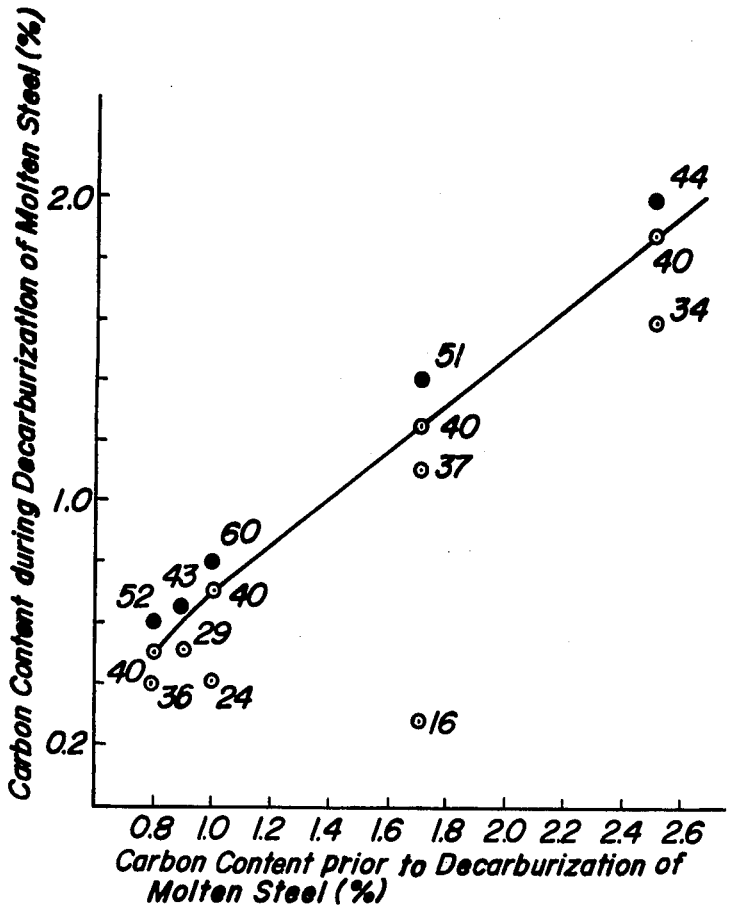
FIG. 4 is a graph showing a relation of the carbon content prior to decarburization of molten steel, the carbon content during decarburization of molten steel, and the finally realized nitrogen content.

In FIG. 4 is shown a relation between the carbon content prior to the decarburization of molten steel and the carbon content during the decarburization with respect to the finally realized nitrogen content. It can be seen from FIG. 4 that the nitrogen content of not more than 40 ppm can be achieved when the decarburization is continued up to the carbon content defined by the equations (1) and (2) in accordance with the carbon content prior to the decarburization of molten steel. In FIG. 4, reference numeral near symbols ○ and ◉ represents a finally realized nitrogen content (ppm).

The invention will be explained with reference to the following examples.

COMPARATIVE EXAMPLE 1

Using a vacuum-ladle decarburization equipment, 52 tons of molten steel (C: 0.37%, Si: 0.4%, Cr: 18.26%, N: 0.0017%) was decarburized to a carbon content of 0.012% in the resulting steel wherein argon gas was flowed into molten steel at a rate of 8 Nl/min per ton of molten steel through porous plugs from the bottom of the ladle, while oxygen gas was blown against molten steel at a rate of 20 $Nm^3$/hr per ton of molten steel under a vacuum degree of 6 to 40 Torr. The resulting steel contained 0.012% of C, 0.10% of Si, 17.86% of Cr and 0.0070% of N and also the chromium loss was 0.40%.

EXAMPLE 1

Using the same equipment as described in Comparative Example 1, 52 tons of molten steel (C: 1.70%, Si: 0.60%, Cr: 17.32%, N: 0.0198%) was decarburized to a carbon content of 0.28% in molten steel wherein argon gas was flowed into molten steel at a rate of 16 Nl/min per ton of molten steel through porous plugs from the bottom of the ladle, while oxygen gas was blown against molten steel at a rate of 14 $Nm^3$/hr per ton of molten steel under a vacuum degree of 6 to 40 Torr. The resulting steel contained 0.28% of C, 0.54% of Si, 17.32% of Cr and 0.0016% of N, so that the chromium loss was not found at all.

EXAMPLE 2

Using the same equipment as described in Comparative Example 1, 52 tons of molten steel (C: 1.01%, Si: 0.60%, Cr: 16.73%, N: 0.0181%) was decarburized to a carbon content of 0.024% in the resulting steel wherein argon gas was flowed into molten steel at a rate of 16 Nl/min per ton of molten steel through porous plugs from the bottom of the ladle, while oxygen gas was blown against molten steel at a rate of 18 $Nm^3$/hr per ton of molten steel under a vacuum degree of 6 to 40 Torr. The resulting steel contained 0.024% of C, 0.24% of Si, 16.74% of Cr and 0.0024% of N, so that the chromium loss was not found at all likewise Example 1.

COMPARATIVE EXAMPLE 2

Using a vacuum-ladle decarburization equipment, 52 tons of molten steel (C: 0.60%, Si: 0.30%, Cr: 27.80%, N: 0.0226%) was decarburized to a carbon content of 0.03% in the resulting steel wherein argon gas was flowed into molten steel at a rate of 6 Nl/min per ton of molten steel through porous plugs from the bottom of the ladle, while oxygen gas was blown against molten steel at a rate of 19 $Nm^3$/hr per ton of molten steel under a vacuum degree of 4 to 60 Torr. The resulting steel contained 0.030% of C, 0.13% of Si, 26.68% of Cr and 0.0081% of N and also the chromium loss was 1.12%.

EXAMPLE 3

Using the same equipment as described in Comparative Example 2, 52 Tons of molten steel (C: 1.10%, Si: 0.60%, Cr: 26.50%, N: 0.0293%) was decarburized to a carbon content of 0.016% in the resulting steel wherein argon gas was flowed into molten steel at a rate of 16 Nl/min per ton of molten steel through porous plugs from the bottom of the ladle, while oxygen gas was blown against molten steel at a rate of 14 $Nm^3$/hr per ton of molten steel under a vacuum degree of 4 to 60 Torr. The resulting steel contained 0.016% of C, 0.83% of Si, 26.28% of Cr and 0.0029% of N and the chromium loss was only 0.22%.

In these examples, the temperature of molten steel was within a range of 1,600° C. to 1,700° C. during the blowing. Generally, it is known that when the temperature of molten steel is lower than 1,600° C., the chromium loss is considerably caused.

As mentioned above, the method of the present invention can stably provide a high chromium steel having a nitrogen content of not more than 0.0040% and restrain the chromium loss to not more than 0.3%.

What is claimed is:

1. A method of denitriding a high chromium molten steel to a nitrogen content of not more than 0.0040% with a minimum chromium loss using a vacuum ladle decarburization equipment, which comprises transferring a high chromium molten steel containing 0.8 to 2.5% of carbon, 10 to 35% of chromium and not more than 0.06% of nitrogen from a steel making furnace into a ladle, putting the ladle in a vacuum tank and then under a vacuum of not more than 60 Torr, flowing an inert gas into the molten steel at a flow rate of not less than 15 Nl/min per ton of molten steel from the bottom of the ladle and concurrently blowing an oxygen gas to the surface of the molten steel until a carbon content [C] in molten steel satisfies the following equations (1) and (2) in accordance with the carbon content prior to decarburization [$\underline{C}$] of molten steel:

$$[C] \leqq [\underline{C}] - 0.3, \text{ when } 0.8 \leqq [\underline{C}] \leqq 1.0\% \quad \ldots (1)$$

$$[C] \leqq 55/70[\underline{C}] - 6/70, \text{ when } 100 \leqq [\underline{C}] \leqq 2.5\% \quad \ldots (2).$$

2. The method as claimed in claim 1, wherein said flow rate of inert gas is 40 Nl/min per ton of molten steel at maximum.

3. The method as claimed in claim 1, wherein said blowing of oxygen gas is carried out at a blow rate ranging between curves a and b shown in FIG. 1 of the accompanying drawings.

4. The method as claimed in claim 1, wherein said oxygen gas is blown against molten steel at a distance between the delivery port for oxygen and the surface of molten steel of from 500 mm to 1,500 mm.

* * * * *